US005566472A

United States Patent [19]

Lehtinen et al.

[11] Patent Number: 5,566,472

[45] Date of Patent: Oct. 22, 1996

[54] SEAL FOR USE AT BAND EDGES IN A DRYING SPACE OF A DRYING APPARATUS

[75] Inventors: Jukka Lehtinen; Paavo Rautakorpi, both of Tampere; Seppo Haavisto, Hämeenkyrö, all of Finland

[73] Assignee: Valmet-Tampella Oy, Tampere, Finland

[21] Appl. No.: 236,456

[22] Filed: May 2, 1994

[51] Int. Cl.[6] ..... F26B 25/00

[52] U.S. Cl. ..... 34/242; 34/95; 34/422; 34/419; 34/69; 34/71; 34/335; 34/634

[58] Field of Search ..... 34/95, 242, 422, 34/419, 69, 71, 335, 634

[56] References Cited

U.S. PATENT DOCUMENTS

| | | | |
|---|---|---|---|
| 3,214,327 | 10/1965 | Wicker et al. | 34/95 |
| 3,214,330 | 10/1965 | Wicker et al. | 34/95 |
| 3,525,160 | 8/1970 | Dokoupil et al. | 34/95 |
| 4,112,586 | 9/1978 | Lehtinen | 34/9 |
| 5,241,759 | 9/1993 | Weidlich et al. | 34/95 |

*Primary Examiner*—Henry A. Bennett
*Assistant Examiner*—Siddmarth Ohri
*Attorney, Agent, or Firm*—Ladas & Parry

[57] ABSTRACT

The invention relates to seals for use at band edges in a Condebelt® apparatus described in Finnish Patent 54 514. In the apparatus, a material web to be dried passes in a substantially airless space between two metal bands (1, 7) or other similar bands or membranes of good thermal conductivity together with drying wires. One of the metal bands is arranged to heat and the other is arranged to cool; the heating band (1) evaporates moisture contained in the web to be dried, the moisture condensing on the surface of the cooling band (7), separated from the web (2) to be dried by drying wires. The drying space between the bands of the Condebelt® apparatus is sealed up at the edges by seal profiles (10, 11) attached to the heating band (1) or the cooling band (7). It is also possible to use a number of seal profiles positioned against each other or side by side.

2 Claims, 1 Drawing Sheet

SEAL FOR USE AT BAND EDGES IN A DRYING SPACE OF A DRYING APPARATUS

This invention relates to seals for use at the edges of a drying space of a Condebelt® drying apparatus described in Finnish Patent 54 514.

In the above-mentioned drying apparatus a material web to, be dried is in a substantially airless space between two metal bands together with drying wires. One of the metal bands is arranged to heat and the other is arranged to cool; the heating band evaporates moisture contained in the web to de dried, and the moisture then condenses on the surface of the cooling band. The drying wires keep the web to be dried apart from the condensing moisture, which remains on the surface of the cooling band and in the drying wires. There are usually two drying wires, of which the coarser one is positioned against the cooling metal bend, while the more fine-textured wire is positioned between the coarse wire and the web.

As the pressure between the metal bands is usually relatively low as compared with ambient pressure, and the wires also leak in the sideward direction, it is necessary to seal up the space between the bands at the edges to prevent leakages. Particularly air leakages in between the bands deteriorate drastically the operation of the drying process. In addition, steam leakages in between the bands are very undesirable as they moisten the web to be dried and may thus disadvantageously increase the pressure prevailing between the bands.

In Finnish Patent 54 514 the seal is shown schematically by a rectangle 23 drawn between the band edges, and a similar representation is to be found in the brochures advertising Condebelt®. However, the more accurate operation or structure of the seal has not been disclosed due to the lack of test results, among other things.

Further product development has resulted in a seal structure where the seal is formed by seal profiles attached to the heating band or cooling band. The profiles may be attached e.g. by gluing or vulcanizing or mechanically.

The seal according to the invention is characterized in that the drying space between the bands of the Condebelt® apparatus is sealed up at the edges by seal profiles attached to the heating band or the cooling band.

In the following the invention will be described more fully with reference to the FIGS. 1 to 5, which show edge areas of respective embodiments of bands of the Condebelt® dryer in cross-section.

Figure 1:
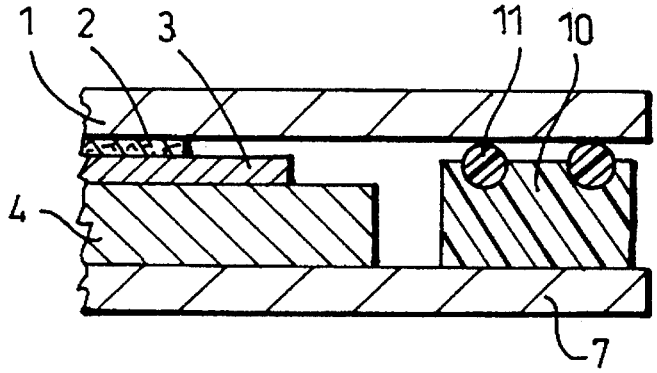

The solution shown in FIG. 1 comprises a heating upper band 1, a web 2 to be dried, a fine wire 3, a cooling lower band 7, and a coarse wire 4 with an edge filling 6. The seal is made of a more rigid main strip 10 into which elastomer strips 11 are embedded. The main strip 10 is attached to the heating band 1 or the cooling band 7 by gluing, vulcanizing or mechanically. The profile may be made e.g. of fibre-reinforced thermosetting plastic or thermoplastic.

Figure 2:
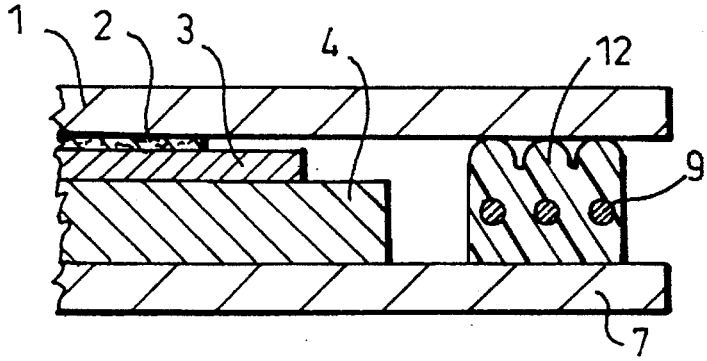

In the solution shown in FIG. 2 the seal is formed by a seal profile 12, which is attached to the heating band 1 or the cooling band 7 by gluing, vulcanizing or mechanically. The profile may contain various reinforcements 9, such as strings or cable wires.

Figure 3:
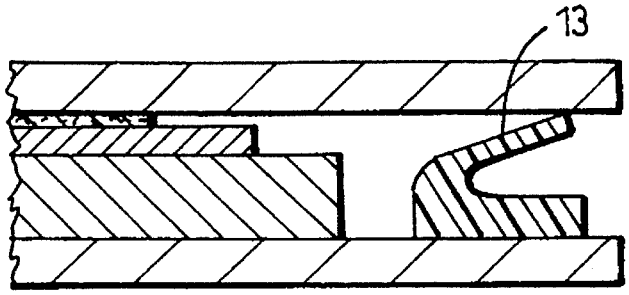

In the solution shown in FIG. 3 the seal is formed by a seal profile 13, which is attached to the heating band 1 or the cooling band 7 by gluing, vulcanizing or mechanically. The profile is outwardly open so that the pressure difference tends to press the profile more tightly against the counter surface. The profile may be made of elastomer of good elasticity properties, and it may be reinforced with fibres to ensure that the elasticity will not deteriorate.

Figure 4:
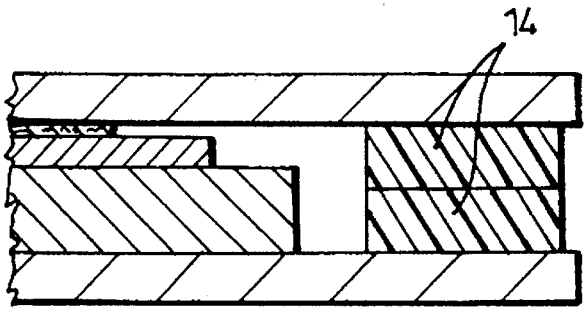

In the solution shown in FIG. 4, the seals are formed by seal profiles 14, which are attached to the heating band 1 and the cooling band 7 against each other.

Figure 5:
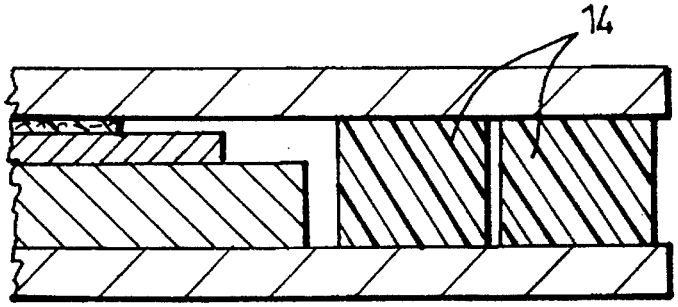

In the solution shown in FIG. 5 the seals are formed by seal profiles 14, which are attached to the heating band 1 and the cooling band 7 side by side.

The elastomeric material of the seals may be e.g. EPDM (ethylene propylene) rubber, or AFLAS™ (tetrafluorethylene) fluoroelastomer; certain polyurethanes may also be used.

As used herein, the term metal band 1, 7 does not only refer to bands made of metal but also to other structures and materials of good thermal conductivity, such as various compacted wire mesh structures and solutions utilizing carbon fibre.

We claim:

1. In a drying apparatus in which a web to be dried passes in a substantially airless drying space between two bands together with at least a first drying wire, one of the bands being arranged to be heated and the other being arranged to be cooled, the web being positioned against the heated band for evaporating moisture contained in the web, the moisture condensing on the cooled band which is separated from the web by the first drying wire, an improved seal between an edge of the heated band and a corresponding edge of the cooled band to prevent leakages thereat between the drying space and a surrounding space comprising the seal being attached to at least one of the heated band and the cooled band, wherein the seal includes a more rigid main strip attached to at least one of the heated band and the cooled band, and elastomer strips embedded in the main strip.

2. In a drying apparatus in which a web to be dried passes in a substantially airless drying space between two bands together with at least a first drying wire, one of the bands being arranged to be heated and the other being arranged to be cooled, the web being positioned against the heated band for evaporating moisture contained in the web, the moisture condensing on the cooled band which is separated from the web by the first drying wire, an improved seal between an edge of the heated band and a corresponding edge of the cooled band to prevent leakages thereat between the drying space and a surrounding space comprising the seal being attached to at least one of the heated band and the cooled band, wherein the material of the seal is reinforced with strings or wire ropes or with a fibre filling.

* * * * *